US008882340B2

(12) United States Patent
Kaelin et al.

(10) Patent No.: US 8,882,340 B2
(45) Date of Patent: Nov. 11, 2014

(54) OSCILLATING WEIGHT

(71) Applicant: ETA SA Manufacture Horlogere Suisse, Grenchen (CH)

(72) Inventors: Laurent Kaelin, Sonvilier (CH); Xavier Tinguely, Fontaines (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 107 days.

(21) Appl. No.: 13/668,839

(22) Filed: Nov. 5, 2012

(65) Prior Publication Data

US 2013/0114381 A1 May 9, 2013

(30) Foreign Application Priority Data

Nov. 8, 2011 (EP) ..... 11188261

(51) Int. Cl.
*G04B 5/16* (2006.01)

(52) U.S. Cl.
CPC ..... *G04B 5/165* (2013.01)
USPC ..... 368/148; 368/208

(58) Field of Classification Search
CPC ..... G04B 5/16; G04B 5/165; G04B 17/063; G04B 5/08; G04B 5/14
USPC ..... 368/207, 208, 148–152
See application file for complete search history.

(56) References Cited

U.S. PATENT DOCUMENTS

| | | | | |
|---|---|---|---|---|
| 3,733,806 | A * | 5/1973 | Murrle | 368/208 |
| 3,942,317 | A | 3/1976 | Schluep | |
| 4,057,885 | A * | 11/1977 | Giger et al. | 29/896.31 |
| 6,354,731 | B1 * | 3/2002 | Halter | 368/148 |
| 2006/0050617 | A1 | 3/2006 | Papi | |
| 2007/0140065 | A1 * | 6/2007 | Levingston | 368/127 |
| 2008/0101163 | A1 * | 5/2008 | Bravo et al. | 368/148 |
| 2010/0054089 | A1 | 3/2010 | Maier et al. | |
| 2012/0195173 | A1 * | 8/2012 | Poffet et al. | 368/208 |
| 2012/0243387 | A1 * | 9/2012 | Jamin et al. | 368/151 |

FOREIGN PATENT DOCUMENTS

| | | |
|---|---|---|
| CH | 249417 | 6/1947 |
| CH | 288208 | 1/1953 |
| CH | 700 711 B1 | 10/2010 |
| EP | 1 445 668 A1 | 8/2004 |
| WO | WO 2008/135817 A2 | 11/2008 |

OTHER PUBLICATIONS

European Search Report issued Jun. 7, 2012, in European Patent Application No. 11188261.9, filed Nov. 8, 2011.

* cited by examiner

*Primary Examiner* — Amy Cohen Johnson
*Assistant Examiner* — Matthew Powell
(74) *Attorney, Agent, or Firm* — Oblon, Spivak, McClelland, Maier & Neustadt, L.L.P.

(57) ABSTRACT

The oscillating weight is intended to be used in a self winding watch mechanism. It includes a basic part (1) made of composite material and heavy metal elements (9). The basic part includes an inner portion (5) and a peripheral portion (3), with the peripheral portion including housings in which the heavy metal elements are set.

10 Claims, 2 Drawing Sheets

OSCILLATING WEIGHT

This application claims priority from European Patent Application No. 11188261.9 filed Nov. 8, 2011, the entire disclosure of which is incorporated herein by reference.

FIELD OF THE INVENTION

The present invention concerns oscillating weights for self-winding watches. The present invention more specifically concerns oscillating weights made of plastic or resin.

PRIOR ART

Watch parts which are made of plastic or synthetic resin are known. These parts can made be made by moulding methods, which has the advantage of enabling various, sometimes very complicated shapes to be obtained without any correction machining operations. These parts also have the characteristic of having a density close 1 and therefore of being light, which is most often an advantage.

However, it will be clear that the characteristic of lightness of the plastic parts may also be a serious drawback. This is the case in particular when the plastic part is intended to be used as an oscillating weight in a self-winding mechanism. Indeed, in a self-winding mechanism, the winding torque is proportional to the unbalance of the oscillating weight.

In order to overcome the aforementioned drawback, U.S. Pat. No. 3,942,317 proposes moulding parts having a density greater than 7. These parts are made from a mass of plastic material, in which a large quantity of heavy metal particles has been dispersed. The proposed method is particularly intended for making oscillating weights for self-winding watch mechanisms. One drawback of the parts produced by this method is that they are brittle. Indeed, tests performed by the Applicant have shown that the oscillating weight tended to break when the watch was subjected to a shock.

One solution that can be envisaged to improve the shock resistance of oscillating weights made via the above method is to also add fibres (glass or carbon fibres for example) to the mass of plastic material charged with heavy metal particles. The presence of fibres has the effect of both increasing stiffness and improving the shock resistance of the injected plastic parts. However, one drawback of this solution is that the simultaneous addition of fibres and heavy metal particles has the effect of considerably increasing the viscosity of the plastic material to be injected. Beyond a certain concentration of fibres and metal particles, the viscosity of the mixture becomes so high that the operation of injecting the preparation into a mould can no longer occur normally. Thus, it will be clear that practical reasons limit the maximum density, and thus the unbalance, of oscillating weights made of plastic charged with heavy metal particles.

BRIEF SUMMARY OF THE INVENTION

It is an object of the present invention to overcome the aforementioned drawbacks by providing a plastic oscillating weight whose density, and more particularly unbalance, is higher than that of known plastic oscillating weights. The present invention achieves this object by providing an oscillating weight for a self-winding watch mechanism in accordance with the annexed claim 1.

It should be specified here that the expression "heavy metal" means any metal whose density is greater than 11 and preferably greater than 17. Moreover, the expression "composite material" generally designates here a material formed of a plastic matrix and a reinforcing portion (preferably in the form of fibres) which ensures mechanical performance.

To form the oscillating weight according to the invention, the composite material is first of all injected into a mould in a liquid state to form the basic part. According to an advantageous variant of the present invention, at least the peripheral part of the basic part is made of a composite material pre-charged with heavy metal particles; preferably tungsten particles. The heavy metal elements of the invention are then set in a housing in the peripheral part of the basic part.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

In the illustrated embodiment, the basic part of the oscillating weight according to the invention is made of a composite material charged with heavy metal particles. It should be recalled, however, that according to other variants of the invention, the basic part may be made from a composite material without any heavy metal particles. The method of forming the uncharged variants is not described in detail here, since those skilled in the art are capable of making this type of basic parts according to the present invention without any difficulty.

The basic part of composite material charged with heavy metal is made as follows. First of all a homogeneous material is prepared containing the plastic material, the heavy metal particles and the reinforcing portion in the form of fibres. This mixture is in the liquid state. Advantageously, it is possible to use commercially available intermediate products to prepare the mixture.

For example, tungsten in the form of polyamide 12 granules (density of 1.02) charged with tungsten powder (density of 19.2) may be obtained. These granules are sold under the trademark GRAVI-TECH® GRV-NJ-110-W by the PolyOne Corporation. The mixture forming the granules has a density of 11.0 and is suitable for injection moulding. Likewise, fibres mixed with polaymide 12 are sold, for example, by the EMS-GRIVORY company under the name GRILAMID® TRVX-50X9 Natur. These are also granules. They are formed of approximately 50% (in volume) glass fibres, the remainder being polyamide 12.

The mixture according to the invention may be made by mixing GRILAMID TR® and GRAVI-TECH® fibres such that the granules preferably comprises between 2.5% and 5% of the total weight of the mixture. This mix of granules is fed into the mould tank of an apparatus which may be an ordinary apparatus. It is clear that the densities of the GRILAMID TR® granules and the GRAVI-TECH® granules are very different. The GRILAMID TR® granules thus tend to be concentrated in the top part of the mixture. It is therefore important to ensure that the mixture is satisfactorily homogeneous, so as to ensure good reproducibility of the moulded parts.

Figure 1A:
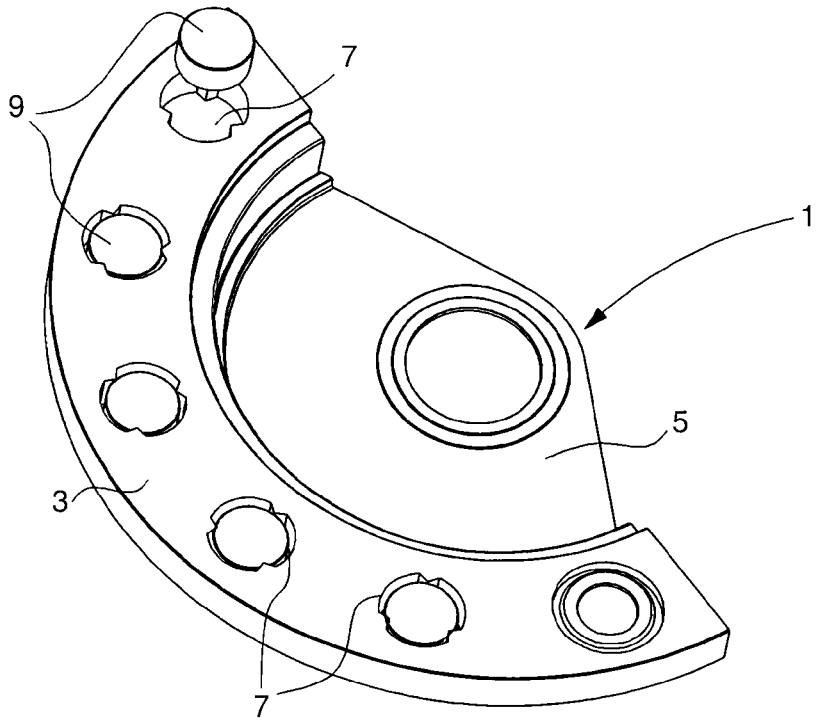
FIG. 1*a* is a perspective view from the movement side of an oscillating weight according to a particular embodiment of the present invention.
Figure 1B:
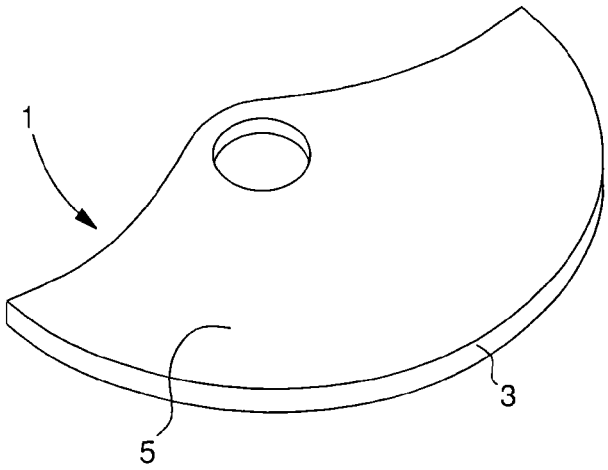
FIG. 1*b* is a perspective view from the back cover side of the oscillating weight of FIG. 1*a*.

Injection moulding the plastic material charged with heavy metal and fibres means that basic parts of relatively complicated shapes can be produced in a single shaping operation, without requiring any correction or finishing operations. By way of example, injection moulding can produce the basic part of the oscillating weight shown in the Figures. This oscillating weight therefore includes a basic part 1 comprising a felloe 3 extending over an arc of a circle of approximately 180° and a plate sector 5 connecting felloe 3 to the axis of rotation of the oscillating weight. It will be clear that felloe 3 forms the peripheral part of the basic part, and that plate sector 5 forms the inner portion of said part. FIG. 1*a* also shows that the peripheral part 3 comprises housings 7 in which discs of heavy metal 9 are set. In the illustrated example, it can be seen that the housings are all placed on the movement side of the oscillating weight and that the back cover side of the oscillating weight (c.f. FIG. 1*b*) has a perfectly smooth surface. This arrangement gives the movement fitted with this oscillating weight a particularly sober attractive appearance.

In the illustrated example, heavy metal discs 9 are snap fitted into cylindrical housings 7 of basic part 1, once said part has been removed from the mould and cooled. One advantage of this method is that it produces oscillating weights with different unbalances from the same basic part. Indeed, it will be clear that the unbalance of the oscillating weight depends to a large extent on the number of heavy metal discs 9 fitted to peripheral portion 3 of the basic part. For example, referring again to the Figures, it is clear that the oscillating weight with the greatest unbalance is obtained by inserting a heavy metal disc 9 in each of the six housings 7 formed in the peripheral portion. An oscillating weight with a lower unbalance can be obtained for example by leaving one housing 7 empty at each end. This arrangement results in a total of four heavy metal discs 9 instead of six.

Figure 2B:
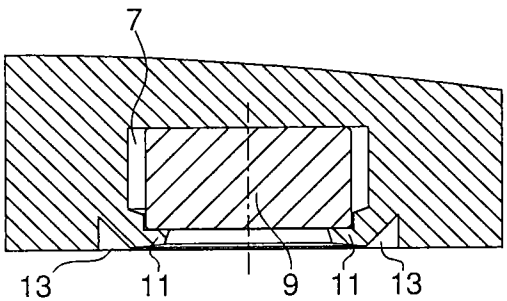
FIG. 2*b* is a cross-section along the line DD of FIG. 2*a*.
Figure 2A:
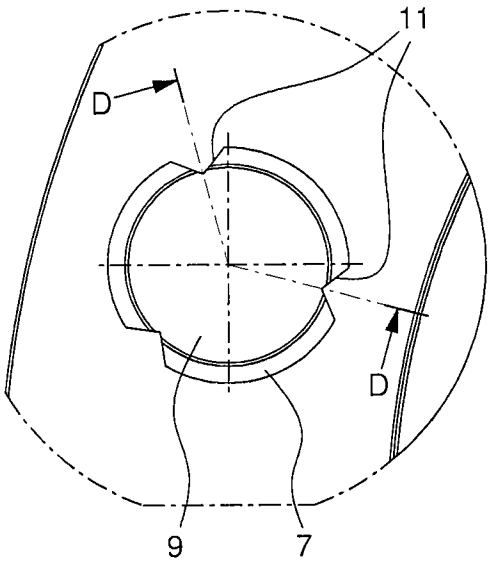
FIG. 2*a* is a partial plan view showing in more detail a heavy metal disc held elastically in its housing by three lugs.

As more particularly illustrated in FIGS. 2A and 2B, in this embodiment, housings 7 are partially closed by small lugs 11 integral with the peripheral portion 3 of the basic part. As shown in the cross-section of FIG. 2B, lugs 11 are arranged to elastically lock the housings once the heavy metal discs 9 have been force fitted or snapped into place. In the illustrated example, each disc 9 is held elastically by three lugs regularly distributed over the circumference of housing 7. It will be clear however that there may be any number of lugs per housing. For example, instead of comprising three lugs separated by 120°, a housing 7 could include four lugs separated by 90°, or even two lugs separated by 180°, or even a single lug.

Figure 3:
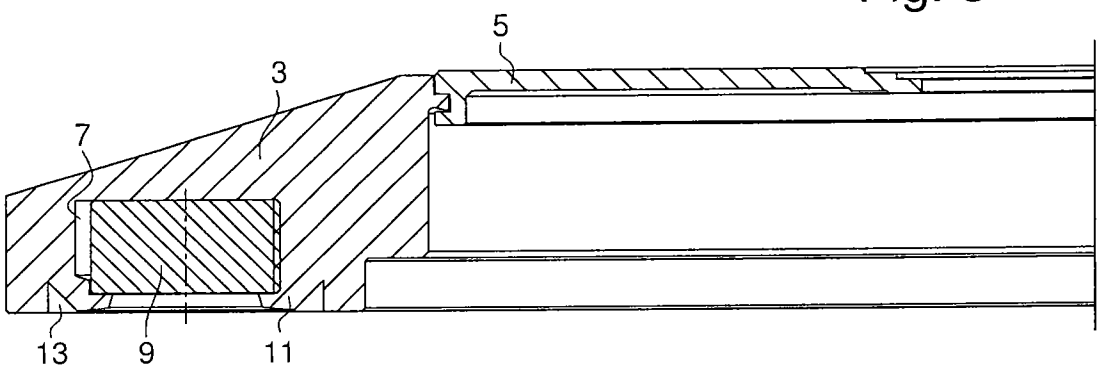
FIG. 3 is a partial cross-section of the oscillating weight of FIGS. 1*a* and 1*b*, with the cross-section passing through the axis of rotation of the oscillating weight and extending radially through the peripheral part thereof.

Referring once again to the cross-section of FIGS. 2B and 3, it is seen that lugs 11 have an indentation 13 at the base thereof to make the lug more flexible. Those skilled in the art will understand that the size of the lug and presence or absence of an indentation at the base thereof essentially depends on the elasticity and flexibility of the composite material used to make the peripheral portion 3 of basic part 1.

It will be clear, however, that instead of being elastically locked in place, the heavy metal elements could equally be bonded to the bottom of the housings, or even each held in their housing by means of a sealing gasket playing the part of a cap to close the housing. Along the same lines, according to a particularly simple variant, housings 7 could be closed on heavy metal discs 9 by means of a simple piece of adhesive strip.

According to a particularly advantageous variant of the present invention, the heavy metal elements or discs 9 could be produced by metal powder pressing and sintering (no mechanical finishing except for thickness adjustment). It is known that discs obtained by powder pressing and sintering can have very high density. Moreover, this variant reuses some of the powder waste. It is therefore particularly economical.

It will also be clear that various alterations and/or improvements evident to those skilled in the art may be made to the embodiment described herein without departing from the scope of the present invention defined by the annexed claims. The basic part could be given the shape of a complete disc rather than a sector of disc. According to this latter variant, the felloe of the basic part (peripheral portion) therefore extends over 360°. The heavy metal elements are only found, however, on a limited sector of the felloe, so as to give the oscillating weight its unbalance.

According to yet another variant, peripheral portion 3 and inner portion 5 of basic part 1 could be made from two different plastic materials. The tungsten charged plastic material could, for example, be injected to form the peripheral segment in a first operation. Next, the plastic material charged only with fibres could be injected in a second operation to form the inner portion of the oscillating weight.

What is claimed is:

1. An oscillating weight for a self winding watch mechanism including a basic part made of composite material and heavy metal elements, the composite material comprising a plastic matrix and a reinforcing filler material, wherein the basic part includes an inner portion and a peripheral portion, and the peripheral portion includes housings inside which the heavy metal elements are set by snap fitting, and wherein said housings are blind holes partially closed by at least one lug integral with the peripheral portion, the lugs being elastic and being arranged to lock the heavy metal elements inside the housings.

2. The oscillating weight according to claim 1, wherein said lug has an indentation at the base thereof arranged to make said lug more flexible.

3. The oscillating weight according to claim 1, wherein the heavy metal elements have the shape of cylindrical discs.

4. The oscillating weight according to claim 3, wherein the housings are blind cylindrical holes partially closed by lugs integral with the cylindrical wall of the holes, the lugs being regularly spaced around the cylindrical holes.

5. The oscillating weight according to claim 4, wherein the lugs have an indentation at the base thereof arranged to make said lugs more flexible.

6. The oscillating weight according to claim 4 or 5, wherein the cylindrical wall of each hole has three regularly spaced lugs.

7. The oscillating weight according to claim 1, wherein the composite material of which the peripheral portion of the basic part is made is charged with heavy metal particles.

8. The oscillating weight according to claim 7, wherein the inner portion and peripheral portion of the basic part are made from two distinct composite materials by overmoulding one of the portions on the other.

9. The oscillating weight according to claim 1, wherein the peripheral portion also includes housings which do not contain any heavy metal elements.

10. The oscillating weight according to claim 1, wherein the heavy metal elements set in the housings are covered with a sealing gasket.

* * * * *